US011313316B1

(12) United States Patent
Gladwin et al.

(10) Patent No.: US 11,313,316 B1
(45) Date of Patent: Apr. 26, 2022

(54) PISTON WITH ENHANCED UNDERCROWN COOLING

(71) Applicant: TENNECO INC., Lake Forest, IL (US)

(72) Inventors: Ross Gladwin, Ypsilanti, MI (US); Patrick Gyetvay, Livonia, MI (US); José Rebello, Ann Arbor, MI (US); Norbert Schneider, Ann Arbor, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 17/406,582

(22) Filed: Aug. 19, 2021

(51) Int. Cl.
*F01P 1/04* (2006.01)
*F02F 3/22* (2006.01)
*F02F 3/00* (2006.01)

(52) U.S. Cl.
CPC ..... *F02F 3/22* (2013.01); *F02F 3/0084* (2013.01); *F02F 3/003* (2013.01); *F02F 3/0023* (2013.01); *F02F 2003/0061* (2013.01)

(58) Field of Classification Search
CPC ..... F02F 3/22; F16J 1/08; F16J 1/09
USPC ..... 123/41.35
See application file for complete search history.

(56) References Cited

U.S. PATENT DOCUMENTS 4,286,505 A * 9/1981 Amdall ..... F02F 3/0015 92/186
4,377,967 A * 3/1983 Pelizzoni ..... F01M 1/08 123/41.35
8,430,070 B2 * 4/2013 Rebello ..... F02F 3/003 123/41.35
10,227,948 B2 * 3/2019 Menotti ..... F02F 3/22
2003/0221639 A1 * 12/2003 Weng ..... F02B 23/0672 123/41.35
2016/0123272 A1 * 5/2016 Neuendorf ..... H01L 35/32 123/193.6

* cited by examiner

*Primary Examiner* — Long T Tran
*Assistant Examiner* — James J Kim
(74) *Attorney, Agent, or Firm* — Robert L. Stearns; Dickinson Wright, PLLC

(57) ABSTRACT

A piston for an internal combustion engine is provided. The piston includes an open inner cooling area in which the undercrown surface is exposed, and an annular outer cooling gallery. The piston also includes an oil outlet scoop for local cooling of the undercrown surface of the piston. The outer cooling gallery includes an oil outlet opening, and the oil outlet scoop is beneath and vertically aligned with the oil outlet opening. The oil outlet scoop includes a concave surface facing the oil outlet opening. During operation, oil exits the oil outlet opening, and the oil outlet scoop catches the exiting oil and directs the oil to the inner cooling area and the exposed undercrown surface.

20 Claims, 1 Drawing Sheet

PISTON WITH ENHANCED UNDERCROWN COOLING

BACKGROUND

1. Field of the Invention

This invention relates generally to pistons for internal combustion engines, more particularly to pistons having oil cooling galleries, and methods of manufacturing.

2. Related Art

Pistons for diesel engines are known for providing enhanced cooling capabilities, which in turn often yield improvements in exhaust emissions and extended service life. In these applications, engine lubricating oil is used to help cool (convectively) an upper crown of the piston which is a very hot region of the piston. The lubricating oil is especially useful for cooling an undercrown surface located opposite a combustion surface of the upper crown, as well as a ring belt of the upper crown of the piston. Pistons oftentimes include an annular, radially outer cooling gallery for containing oil near the ring belt, a central cooling gallery for containing oil beneath the undercrown surface, or both types of galleries (dual galleries). The cooling galleries can be designed with open or closed geometries.

Dual gallery pistons typically include the outer cooling gallery and the central cooling gallery which is open between upper and lower crown portions. The outer and central galleries can either be isolated from one another or arranged in fluid communication with one another via oil passages extending through intervening ribs. In addition, the piston can include pin lubrication passages extending from one or both of the galleries to a wrist pin. The outer cooling gallery, whether formed as a single or dual gallery construction, is particularly suited for cooling the bowl rim and ring belt region of the piston. The central gallery, if present, is particularly suited for cooling a central region of the upper crown, including the undercrown surface and the combustion surface which is directly exposed to hot combustion gases.

The combustion surface and undercrown surface are exposed to extreme heat in use. Oil jets can be used to direct oil to inside surfaces of the piston. However, typically, the undercrown surface receives very little oil spray or splashing, especially in pistons with reduced jet flow rates. Without proper management of heat in this region, several problems can result. For example, overtime, carbon build-up on the undercrown surface can form. This carbon build up can reduce heat transfer from the combustion surface leading to higher temperatures in the upper crown of the piston. This carbon build up can eventually flake off, and loose carbon flakes can be caught between moving components and cause damages. Another problem associated with excessive heat build-up relates to exhaust emissions. If combustion temperatures are not tightly controlled in engines, the combustion process cannot be optimally regulated for efficiency and emissions concerns. Further, if the piston temperatures are allowed to rise too high, the lubricating oil can become over-heated and begin to chemically break down prematurely, thus reducing its service life.

Over the years, engine designers have sought to provide sufficient oil flow along the upper crown of the piston while at the same time avoid deterioration of the oil due to over-heating. If an insufficient supply of oil is directed to the undercrown surface, or if the oil is allowed to remain in the region for too long, the oil over-heats and its cooling and lubrication functions are diminished. As such, an ample flow of cooling oil must be provided in order to properly regulate the temperature of the upper crown, specifically in the region located along the undercrown surface.

One technique used to reduce the temperature of the upper crown of a diesel piston is disclosed in U.S. Pat. No. 8,430,070. The '070 patent discloses a tubular cooling nozzle extending from an outlet of the outer cooling gallery to convey oil from the outer cooling gallery toward the undercrown surface.

However, there remains a need for improved cooling of the piston during use, and more specifically improved techniques for cooling the region located along the undercrown surface of the piston.

SUMMARY

One aspect of the invention provides a piston for an internal combustion engine with improved cooling during use, and more specifically improved cooling of a region located along an undercrown surface of the piston. The piston includes an upper crown presenting a combustion surface and the undercrown surface, and a ring belt depending from the combustion surface. The piston further includes an inner cooling area disposed along the undercrown surface. The inner cooling area is open to expose the undercrown surface. An outer cooling gallery is formed along the upper crown and the ring belt. The outer cooling gallery is annular and surrounds the inner cooling area. The outer cooling gallery includes an oil outlet opening, and an oil outlet scoop is vertically aligned with and spaced from the oil outlet opening. During use of the piston in an internal combustion engine, the oil outlet scoop collects the outcoming oil from the outer cooling gallery and directs the oil into the inner cooling area and toward the undercrown surface.

Another aspect of the invention provides a method of manufacturing a piston. The method includes providing a piston body including an upper crown presenting a combustion surface and an undercrown surface. The piston body includes a ring belt depending from the combustion surface, and an inner cooling area disposed along the undercrown surface, wherein the inner cooling area is open to expose the undercrown surface. The piston body also includes an outer cooling gallery formed along the upper crown and the ring belt. The outer cooling gallery is annular and surrounds the inner cooling area. The outer cooling gallery includes an oil outlet opening, and the method further includes connecting an oil outlet scoop to the piston body such that the oil outlet scoop is spaced from and vertically aligned with the oil outlet opening for collecting oil from the outer cooling gallery and directing the oil into the inner cooling area and toward the undercrown surface.

BRIEF DESCRIPTION OF THE DRAWINGS

These and other features and advantages of the present invention will become more readily appreciated when considered in connection with the following detailed description and appended drawing.

DETAILED DESCRIPTION OF EXAMPLE EMBODIMENTS

Figure 1:
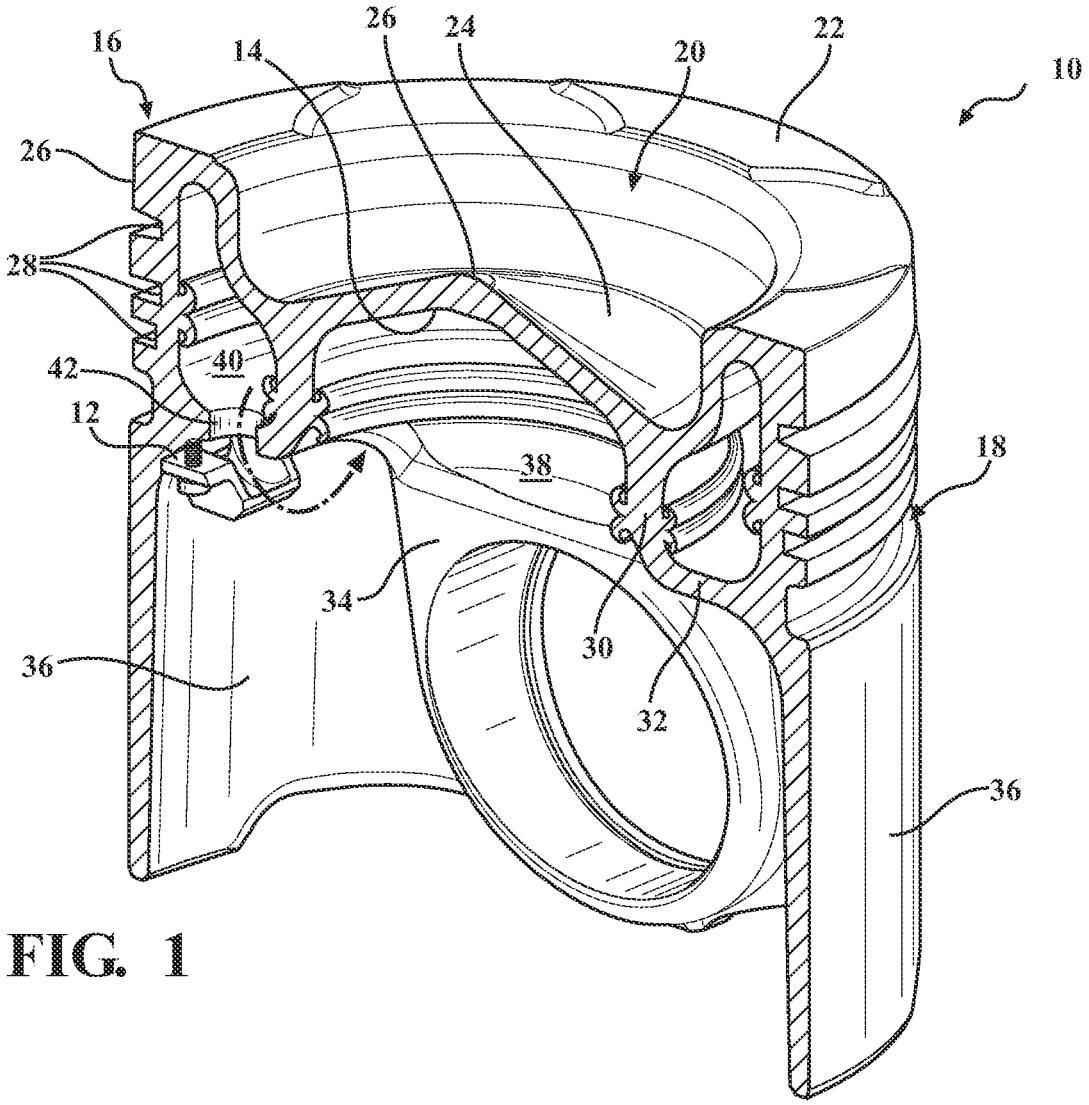
FIG. 1 is a perspective and cross-sectional view of a piston with an oil outlet scoop according to an example embodiment.
Figure 2:
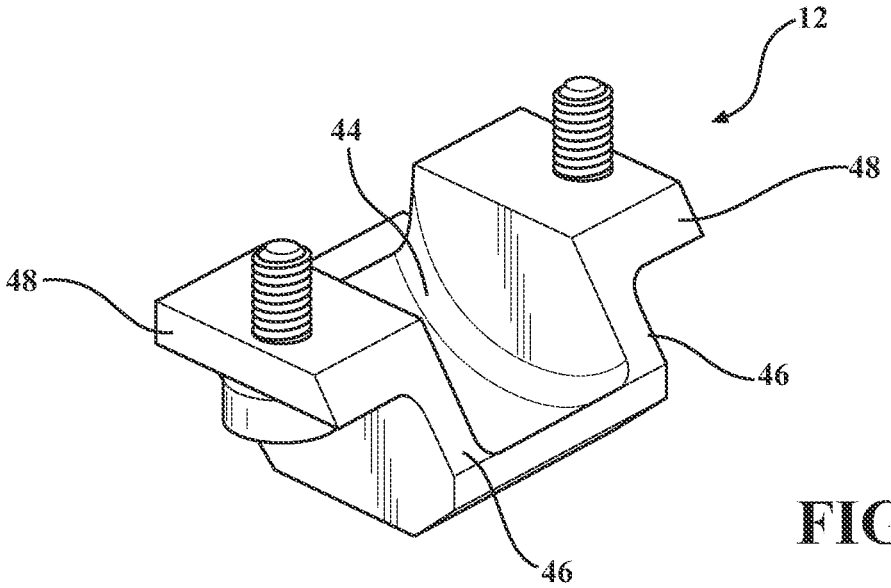
FIG. 2 is an enlarged view of the oil outlet scoop of FIG. 1.

One aspect of the invention provides a piston 10 for an internal combustion engine which includes an oil outlet scoop 12 to enhance cooling of an undercrown surface 14 of the piston 10 during use in the engine. An example of the piston 10 is shown in FIG. 1.

The piston 10 includes a body portion which can comprise various different designs. The body portion is typically formed of steel and designed for diesel engines. However, the body portion can be formed of other materials and comprise other designs. The piston 10 could alternatively be designed for use in a natural gas engine or hydrogen combustion engine.

The body portion includes an upper crown 16 and a lower crown 18. Typically, the upper and lower crowns 16, 18 are joined together, for example by welding, but the upper and lower crowns 16, 18 could alternatively be a single piece.

The upper crown 16 includes a combustion surface 20 facing a combustion chamber during use of the piston 10. According to the example embodiment, the combustion surface 20 includes a planar, annular outer rim 22 surrounding a combustion bowl 24. An apex 26 is located at the center of the combustion bowl 24. The upper crown 16 also includes the undercrown surface 14 facing opposite the combustion surface 20.

The upper crown 16 also includes an upper portion of an annular ring belt 26 which depends from the outer rim 22. The ring belt 26 includes a plurality of ring grooves 28 for containing piston rings. The upper crown 16 also includes a portion of an annular inner wall 30 disposed inwardly of the ring belt 26 and depending from the undercrown surface 14.

According to the example embodiment, the lower crown 18 includes a lower portion of the ring belt 26 and a lower portion of the inner wall 30 which are welded or otherwise joined to the upper portion of the ring belt 26 and the upper portion of the inner wall 30. The lower crown 18 also includes a lower wall 32 connecting the ring belt 26 to the inner wall 30.

According to the example embodiment, the body portion of the piston 10 also includes a pair of pin bosses 34 depending from the ring belt 26 of the lower crown 18. The pin bosses 34 each present a pin bore for receiving a pin. The body portion also includes a pair of skirt sections 36 which depend from the ring belt 26 and are spaced from one another by the pin bosses 34.

As shown in FIG. 1, the piston 10 includes an inner cooling area 38 disposed along the undercrown surface 14. The inner cooling area 38 is surrounded by the undercrown surface 14 and the annular inner wall 30. The inner cooling area 38 is open, with no lower boundary, so that the undercrown surface 14 surrounded by the annular inner wall 30 is exposed.

The piston 10 also includes an annular outer cooling gallery 40 surrounded the inner cooling area 38. The outer cooling gallery 40 is formed between the undercrown surface 14, the ring belt 26, the lower wall 32, and the inner wall 30. An oil outlet opening 42 is located in the lower wall 32. During operation, cooling oil is provided to and travels through the outer cooling gallery 40 to cool the body portion of the piston 10. The cooling oil is able to exit the outer cooling gallery 40 through the oil outlet opening 42.

As shown in FIG. 1, the oil outlet scoop 12 is disposed beneath the oil outlet opening 42 for collecting oil that exits the outer cooling gallery 40 and directing the oil into the inner cooling area 38 and toward the undercrown surface 14. The oil outlet scoop 12 is vertically aligned with and spaced from the oil outlet opening 42. The oil outlet scoop 12 does not impede the exiting of the oil through the oil outlet opening 42.

The oil outlet scoop 12 includes a concave surface 44 facing the oil outlet opening 42. The concave surface 44 is designed so that during operating, the oil exits the outer cooling gallery 40 and is directed to the undercrown surface 14. However, the shape of the oil outlet scoop 12 can vary as long as it is still capable of directing the oil from the outer cooling gallery 40 to the undercrown surface 14.

According to the example embodiment, the oil outlet scoop 12 includes side walls 46 located on opposite sides of and extending upward from the concave surface 44. Lower ends of the side walls 46 are concave and matches the shape of the concave surface 44. According to the example embodiment, the side walls 46 are flat and parallel to one another. However, the side walls 46 could comprise other shapes, for example curved or at angles relative to one another. The oil outlet scoop 12 includes openings between the side walls 46 which space the side walls 46 from one another. The oil outlet scoop 12 of the example embodiment also includes a pair of flanges 48. Each flange 48 extends from a top of one of the side walls 46 away from the concave surface 44 and perpendicular to the side walls 46. The flanges 48 can be bolted, spot welded, glued, or connected by another method to the body portion of the piston 10. In the example embodiment, the flanges 48 are bolted to the lower wall 32 of the body portion. The flanges 48 are the only portion of the oil outlet scoop 12 which is in contact with the body portion. The side walls 46 and the concave surface 44 are completely spaced from the body portion. The oil outlet scoop 12 is typically formed of steel, but can be formed of another material.

Another aspect of the invention provides method of manufacturing the piston 10 with the oil outlet scoop 12. The method includes providing the piston body described above and connecting the oil outlet scoop 12 to the piston body such that the oil outlet scoop 12 is spaced from and vertically aligned with the oil outlet opening 42 for collecting oil from the outer cooling gallery 40 and directing the oil into the inner cooling area 38 and toward the undercrown surface 14.

As discussed above, the piston 10 including the oil outlet scoop 12 provides for local cooling of the undercrown surface 14, which leads to performance advantages. The oil outlet scoop 12 is designed so that it does not impede the outflow of oil from the outer cooling gallery 40 and it does not interfere with the dwell time of the oil in the outer cooling gallery 40. The concave surface 44 distributes a broader and larger volume of oil to the undercrown surface 14 compared to the tubular cooling nozzle disclosed in U.S. Pat. No. 8,430,070.

Obviously, many modifications and variations of the present invention are possible in light of the above teachings and may be practiced otherwise than as specifically described while within the scope of the following claims. In particular, all features of all claims and of all embodiments can be combined with each other, as long as they do not contradict each other.

What is claimed is:

1. A piston, comprising:

an upper crown presenting a combustion surface and an undercrown surface;

a ring belt depending from said combustion surface;

an inner cooling area disposed along said undercrown surface, said inner cooling area being open to expose said undercrown surface;

an outer cooling gallery formed along said upper crown and said ring belt, said outer cooling gallery being annular and surrounding said inner cooling area;

said outer cooling gallery including an oil outlet opening; and an oil outlet scoop being vertically aligned with and spaced from said oil outlet opening for collecting oil from said outer cooling gallery and directing the oil into said inner cooling area and toward said undercrown surface.

2. The piston of claim 1, wherein said oil outlet scoop includes a concave surface facing said oil outlet.

3. The piston of claim 2, wherein said oil outlet scoop includes side walls located on opposite sides of and extending upward from said concave surface, said side walls being parallel to one another.

4. The piston of claim 3, wherein said oil outlet scoop includes a pair of flanges, each flange extending from a top of one of said side walls away from said concave surface and perpendicular to said side walls.

5. The piston of claim 4, wherein said flanges are bolted to a portion of said piston.

6. The piston of claim 4, wherein said flanges connect said oil outlet scoop to said piston, and said flanges are the only portion of said oil outlet scoop which is in contact with said piston.

7. The piston of claim 1, wherein said oil outlet scoop is bolted, welded, or glued to a portion of said piston.

8. The piston of claim 1 including a lower wall extending inward from said ring belt; and an inner wall extending from said undercrown surface to said lower wall; and said undercrown surface, said ring belt, said lower wall, and said inner wall together form said cooling gallery.

9. The piston of claim 8, wherein said oil outlet is located in said lower wall and said concave surface is vertically aligned with said oil outlet.

10. The piston of claim 8, wherein said oil outlet scoop is attached to said lower wall.

11. The piston of claim 10, wherein said oil outlet scoop is bolted to said lower wall.

12. The piston of claim 8, wherein said upper crown includes an upper portion of said ring belt and an upper portion of said inner wall; and said piston includes a lower crown attached to said upper portion; said lower crown includes a lower portion of said ring belt, a lower portion of said inner wall, and said lower wall.

13. The piston of claim 12, wherein said lower crown is welded to said upper crown.

14. The piston of claim 12 including a pair of pin bosses depending from said ring belt of said lower crown, said pin bosses each presenting a pin bore for receiving a pin; and a pair of skirt sections depending from said ring belt and spaced from one another by said pin bosses.

15. The piston of claim 1, wherein said oil outlet scoop is formed of steel.

16. The piston of claim 1, wherein said upper crown and said ring belt are formed of steel.

17. The piston of claim 1, wherein said piston is formed of steel.

18. The piston of claim 1, wherein said combustion surface includes a rim having a planar shape, a bowl surrounded by said rim, and an apex located at a center of said bowl.

19. A method of manufacturing a piston, comprising the steps of:

providing a piston body including an upper crown presenting a combustion surface and an undercrown surface, the piston body including a ring belt depending from the combustion surface, the piston body including an inner cooling area disposed along the undercrown surface, the inner cooling area being open to expose the undercrown surface, the piston body including an outer cooling gallery formed along the upper crown and the ring belt, the outer cooling gallery being annular and surrounding the inner cooling area, and the outer cooling gallery including an oil outlet opening; and connecting an oil outlet scoop to the piston body such that the oil outlet scoop is spaced from and vertically aligned with the oil outlet opening for collecting oil from the outer cooling gallery and directing the oil into the inner cooling area and toward the undercrown surface.

20. The method of claim 19, wherein the oil outlet scoop includes side walls located on opposite sides of and extending upward from the concave surface, the side walls are parallel to one another, the oil outlet scoop includes a pair of flanges, each flange extends from a top of one of the side walls away from the concave surface and perpendicular to the side walls, and the method further includes connecting the flanges to the piston body, wherein the flanges are the only portion of the oil outlet scoop which is in contact with the piston body.

* * * * *